US011211720B2

(12) United States Patent
Ueda

(10) Patent No.: US 11,211,720 B2
(45) Date of Patent: Dec. 28, 2021

(54) HIGH-FREQUENCY MODULE AND COMMUNICATION DEVICE

(71) Applicant: Murata Manufacturing Co., Ltd., Kyoto (JP)

(72) Inventor: Hideki Ueda, Kyoto (JP)

(73) Assignee: MURATA MANUFACTURING CO., LTD., Kyoto (JP)

( * ) Notice: Subject to any disclaimer, the term of this patent is extended or adjusted under 35 U.S.C. 154(b) by 35 days.

(21) Appl. No.: 16/880,096

(22) Filed: May 21, 2020

(65) Prior Publication Data

US 2020/0287298 A1 Sep. 10, 2020

Related U.S. Application Data

(63) Continuation of application No. PCT/JP2018/041649, filed on Nov. 9, 2018.

(30) Foreign Application Priority Data

Nov. 22, 2017 (JP) ..... JP2017-224640

(51) Int. Cl.
*H01Q 21/00* (2006.01)
*H01Q 21/24* (2006.01)
(Continued)

(52) U.S. Cl.
CPC ..... *H01Q 21/24* (2013.01); *H01Q 5/307* (2015.01); *H01Q 9/0407* (2013.01); *H01Q 1/24* (2013.01);
(Continued)

(58) Field of Classification Search
CPC ..... H01Q 21/24; H01Q 9/0407; H01Q 5/307; H01Q 21/0025; H01Q 1/24; H01Q 1/243; H01Q 21/065
See application file for complete search history.

(56) References Cited

U.S. PATENT DOCUMENTS 6,147,648 A 11/2000 Granholm et al.
2004/0095282 A1 5/2004 Fukushima et al.
(Continued)

FOREIGN PATENT DOCUMENTS

JP H05175727 A 7/1993
JP H11355038 A 12/1999
(Continued)

OTHER PUBLICATIONS

International Search Report issued in Application No. PCT/JP2018/041649, dated Jan. 29, 2019.
(Continued)

*Primary Examiner* — Joseph J Lauture
(74) *Attorney, Agent, or Firm* — Pearne & Gordon LLP

(57) ABSTRACT

A high-frequency module (1) includes a multilayer dielectric substrate (2), an RFIC (21), and an array antenna (13). The array antenna (13) includes a plurality of first patch antennas (11) having identical polarization directions with each other, and a plurality of second patch antennas (12) having identical polarization directions with each other, which are polarization directions positioned between two orthogonal polarizations of the first patch antenna (11). The first patch antenna (11) and the second patch antenna (12) simultaneously operate as a transmitting antenna or a receiving antenna.

20 Claims, 5 Drawing Sheets

(51) Int. Cl.

| | |
|---|---|
| ***H01Q 5/307*** | (2015.01) |
| ***H01Q 9/04*** | (2006.01) |
| *H01Q 21/06* | (2006.01) |
| *H01Q 1/24* | (2006.01) |

(52) U.S. Cl.
CPC ..... *H01Q 1/243* (2013.01); *H01Q 21/0025* (2013.01); *H01Q 21/065* (2013.01)

(56) References Cited

U.S. PATENT DOCUMENTS

| | | | | |
|---|---|---|---|---|
| 2009/0322621 | A1 | 12/2009 | Inanoglu et al. | |
| 2015/0263435 | A1 | 9/2015 | Song et al. | |
| 2018/0205358 | A1 | 7/2018 | Onaka et al. | |
| 2019/0132851 | A1* | 5/2019 | Davydov ..... | H04B 7/0874 |

FOREIGN PATENT DOCUMENTS

| | | | |
|---|---|---|---|
| JP | 2000508144 | A | 6/2000 |
| JP | 2004088199 | A | 3/2004 |
| JP | 2011527151 | A | 10/2011 |
| JP | 2017508402 | A | 3/2017 |
| WO | 2017047199 | A1 | 3/2017 |

OTHER PUBLICATIONS

Written Opinion issued in Application No. PCT/JP2018/041649, dated Jan. 29, 2019.

* cited by examiner

HIGH-FREQUENCY MODULE AND COMMUNICATION DEVICE

This is a continuation of International Application No. PCT/JP2018/041649 filed on Nov. 9, 2018 which claims priority from Japanese Patent Application No. 2017-224640 filed on Nov. 22, 2017. The contents of these applications are incorporated herein by reference in their entireties.

BACKGROUND OF THE DISCLOSURE

Field of the Disclosure

The present disclosure relates to a high-frequency module and a communication device suitable for use in high-frequency signals such as microwaves, millimeter waves, and the like.

Description of the Related Art

As a high-frequency module used for high-frequency signals, a module having an array antenna which includes a plurality of dual-polarized antennas, each radiates two polarizations orthogonal to each other is known (see, for example, Patent Documents 1 to 3). Patent Document 1 discloses a configuration in which two planar antennas having mutually different resonance frequencies are included, and these two planar antennas are arranged at a specified distance from each other and are rotated by a specified angle from each other. Patent Document 2 discloses that two polarization antenna elements orthogonal to each other are paired and a polarization diversity antenna has a plurality of these pairs. Patent Document 3 discloses a dual polarization antenna array including a plurality of antenna elements.

Patent Document 1: Japanese Unexamined Patent Application Publication No. 5-175727

Patent Document 2: Japanese Unexamined Patent Application Publication No. 11-355038

Patent Document 3: Japanese Unexamined Patent Application Publication (Translation of PCT Application) No. 2000-508144

BRIEF SUMMARY OF THE DISCLOSURE

Incidentally, in the two planar antennas described in Patent Document 1, one is for transmission and the other is for reception. That is, the planar antenna for transmission cannot be used at the time of reception, and the planar antenna for reception cannot be used at the time of transmission. For this reason, for example, only half of the planar antennas can be used during the transmission or reception to the area of the antenna region. As a result, there is a problem that the antenna gain and equivalent Isotropic Radiated (EIRP) are low.

On the other hand, the antenna described in Patent Document 2 does not ensure the isolation between the antenna elements, but improves the isolation at a feed point corresponding to each polarization by using tournament chart-like wiring. This is the same for the antenna array described in Patent Document 3. Thus, there is a problem in that the isolation cannot be ensured in the configuration of a phased array antenna including a plurality of RF terminals and phase shifters.

The present disclosure has been made in view of the above-described problems of the related art, and an object of the present disclosure is to provide a high-frequency module and a communication device capable of enhancing EIRP and enhancing isolation between a plurality of antennas.

In order to solve the above-described problems, in the present disclosure, a high-frequency module includes a multilayer dielectric substrate, an RFIC having a plurality of RF input/output terminals connected to the multilayer dielectric substrate, and an array antenna configured by a plurality of dual-polarized antennas, each placed in or on the multilayer dielectric substrate and radiating two orthogonal polarizations, in which the RFIC has at least, for each of the plurality of RF input/output terminals, a switching device for switching on/off of input or output of an RF signal and a variable phase shifter, and two of the plurality of RF input/output terminals are respectively connected to feed points corresponding to orthogonal polarizations in each of the plurality of dual-polarized antennas, in which the plurality of dual-polarized antennas are configured by a plurality of first dual-polarized antennas having identical polarization directions with each other and a plurality of second dual-polarized antennas having identical polarization directions with each other, which are polarization directions positioned between two orthogonal polarizations of each of the first dual-polarized antennas, and each of the first dual-polarized antennas and each of the second dual-polarized antennas simultaneously operate as a transmitting antenna or a receiving antenna.

According to the present disclosure, EIRP can be enhanced, and the isolation between a plurality of antennas can be enhanced.

DETAILED DESCRIPTION OF THE DISCLOSURE

Hereinafter, a high-frequency module according to an embodiment of the present disclosure will be described in detail with reference to the accompanying drawings, taking an example in which the high-frequency module is applied to, for example, a communication device for millimeter waves. Note that in the present embodiment, of three-axis directions orthogonal to each other (X-axis direction, Y-axis direction, and Z-axis direction), a polarization parallel to the X-axis direction is defined as a horizontal polarization, and a polarization parallel to the Y-axis direction is defined as a vertical polarization.

Figure 1:
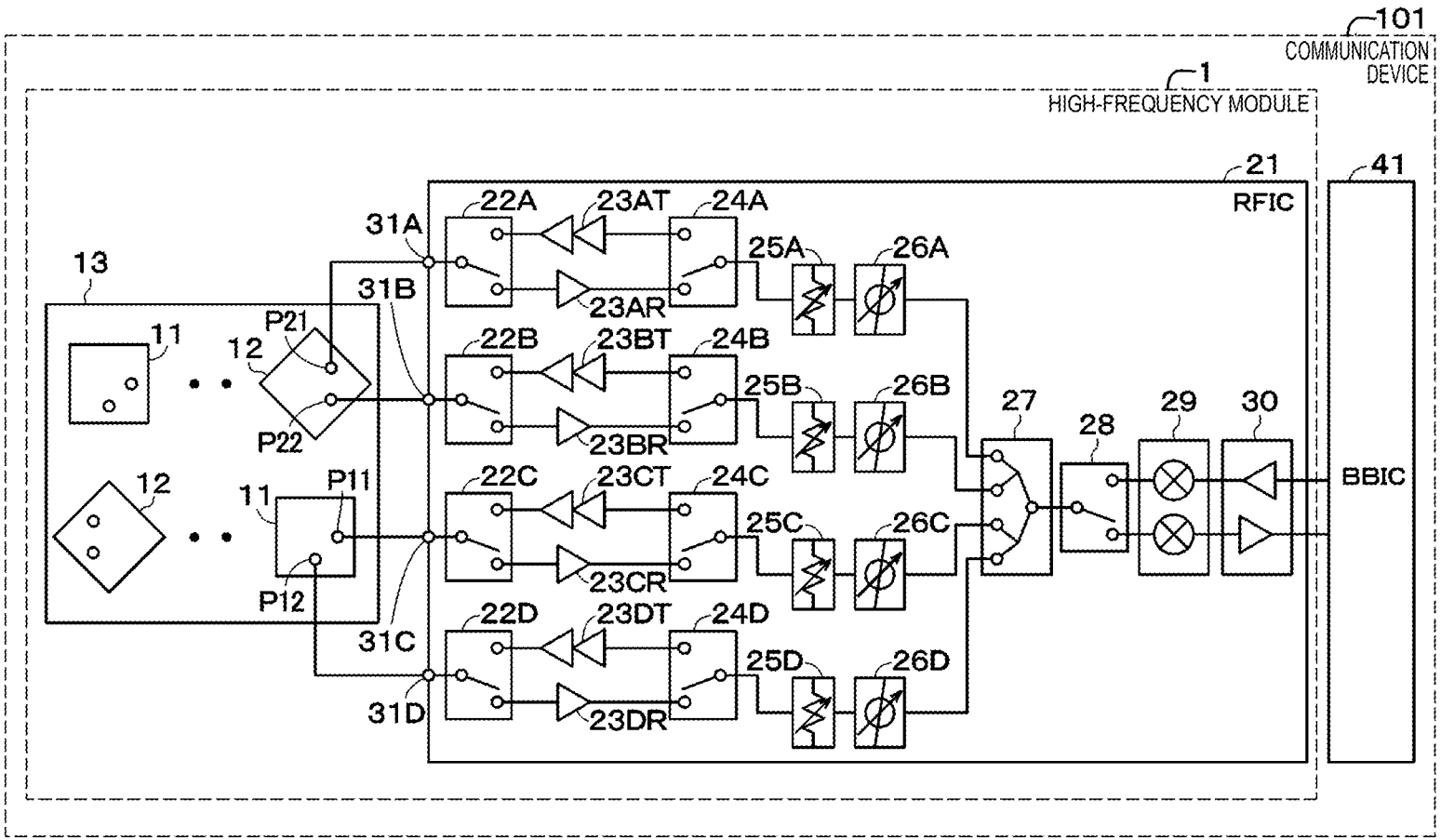
FIG. 1 is a block diagram illustrating a communication device according to an embodiment of the present disclosure.

FIG. 1 is a block diagram illustrating an example of a communication device 101 to which a high-frequency module 1 according to the present embodiment is applied. The communication device 101 is, for example, a mobile terminal such as a cellular phone, a smartphone, a tablet, or the like, or a personal computer or the like having a communication function.

The communication device 101 includes the high-frequency module 1 and a baseband IC 41 (hereinafter, referred to as a BBIC 41) that constitutes a baseband signal processing circuit. The high-frequency module 1 includes an array antenna 13 and an RFIC 21 which is an example of a power feed circuit. The communication device 101 up-converts a signal transmitted from the BBIC 41 to the high-frequency module 1 to a high-frequency signal to radiate the signal to the array antenna 13, and downconverts a high-frequency signal received by the array antenna 13 to process a signal in the BBIC 41.

In FIG. 1, for ease of explanation, only configurations corresponding to a first feed point P11 and a second feed point P12 of one first patch antenna 11, and a first feed point P21 and a second feed point P22 of one second patch antenna 12 are illustrated among a plurality of first patch antennas 11 and a plurality of second patch antennas 12 constituting the array antenna 13, and configurations corresponding to the other first patch antennas 11 and second patch antennas 12 are omitted.

The RFIC 21 (high-frequency integrated circuit) includes switches 22A to 22D, 24A to 24D, and 28, power amplifiers 23AT to 23DT, low noise amplifiers 23AR to 23DR, attenuators 25A to 25D, variable phase shifters 26A to 26D, a signal multiplexer/demultiplexer 27, a mixer 29, and an amplifier circuit 30. The RFIC 21 is connected to the BBIC 41.

The RFIC 21 includes a plurality of RF input/output terminals 31A to 31D. The switches 22A to 22D are connected to the first feed point P11 and the second feed point P12 of the first patch antenna 11, and to the first feed point P21 and the second feed point P22 of the second patch antenna 12 via the RF input/output terminal 31A to 31D.

When high-frequency signals RF11, RF12, RF21, and RF22 are transmitted, the switches 22A to 22D and 24A to 24D are switched to the power amplifiers 23AT to 23DT sides, and the switch 28 is connected to the transmission side amplifier of the amplifier circuit 30. When the high-frequency signals RF11, RF12, RF21, and RF22 are received, the switches 22A to 22D and 24A to 24D are switched to the low noise amplifiers 23AR to 23DR sides, and the switch 28 is connected to the reception side amplifier of the amplifier circuit 30.

The signal transmitted from the BBIC 41 is amplified by the amplifier circuit 30 and up-converted by the mixer 29. The transmission signals which are the up-converted high-frequency signals RF11, RF12, RF21, and RF22 are demultiplexed to four by the signal multiplexer/demultiplexer 27, passed through four signal paths, and fed to the first feed point P11 and the second feed point P12 of the first patch antenna 11, and to the first feed point P21 and the second feed point P22 of the second patch antenna 12. At this time, the variable phase shifters 26A to 26D disposed in the respective signal paths individually adjust the phases of the high-frequency signals RF11, RF12, RF21, and RF22, so that the directivity of the array antenna 13 can be adjusted.

The reception signals which are high-frequency signals RF11, RF12, RF21, and RF22 received by the first patch antenna 11 and the second patch antenna 12 are multiplexed by the signal multiplexer/demultiplexer 27 via the four different signal paths. The multiplexed reception signal is down-converted by the mixer 29, amplified by the amplifier circuit 30, and transmitted to the BBIC 41.

The RFIC 21 is formed as, for example, a one-chip integrated circuit component including the circuit configuration described above. Alternatively, the devices (switches, power amplifiers, low noise amplifiers, attenuators, and variable phase shifters) corresponding to each of the feed points P11, P12, P21, and P22 in the RFIC 21 may be formed as one-chip integrated circuit components for each of the corresponding feed points P11, P12, P21, and P22.

The switching devices for switching on/off of input or output of the high-frequency signals RF11, RF12, RF21, and RF22 are not limited to the switches 22A to 22D, 24A to 24D, and 28. The switching devices may be, for example, the power amplifiers 23AT to 23DT or the low noise amplifiers 23AR to 23DR. That is, by adjusting the gains of the power amplifiers 23AT to 23DT or the low noise amplifiers 23AR to 23DR, the on/off of the input or output of the high-frequency signals RF11, RF12, RF21, and RF22 may be switched. The power amplifiers 23AT to 23DT and the low noise amplifiers 23AR to 23DR may switch between driving and stopping. The switching devices may be provided separately from the switches 22A to 22D, 24A to 24D, and 28 for switching between transmission and reception, and may be switches capable of switching on/off for the respective paths. Further, the variable phase shifters 26A to 26D may be digital phase shifters or analog phase shifters.

Next, the high-frequency module 1 according to the embodiment of the present disclosure will be described. FIGS. 2 to 6 illustrate the high-frequency module 1 according to the embodiment of the present disclosure.

Figure 4:
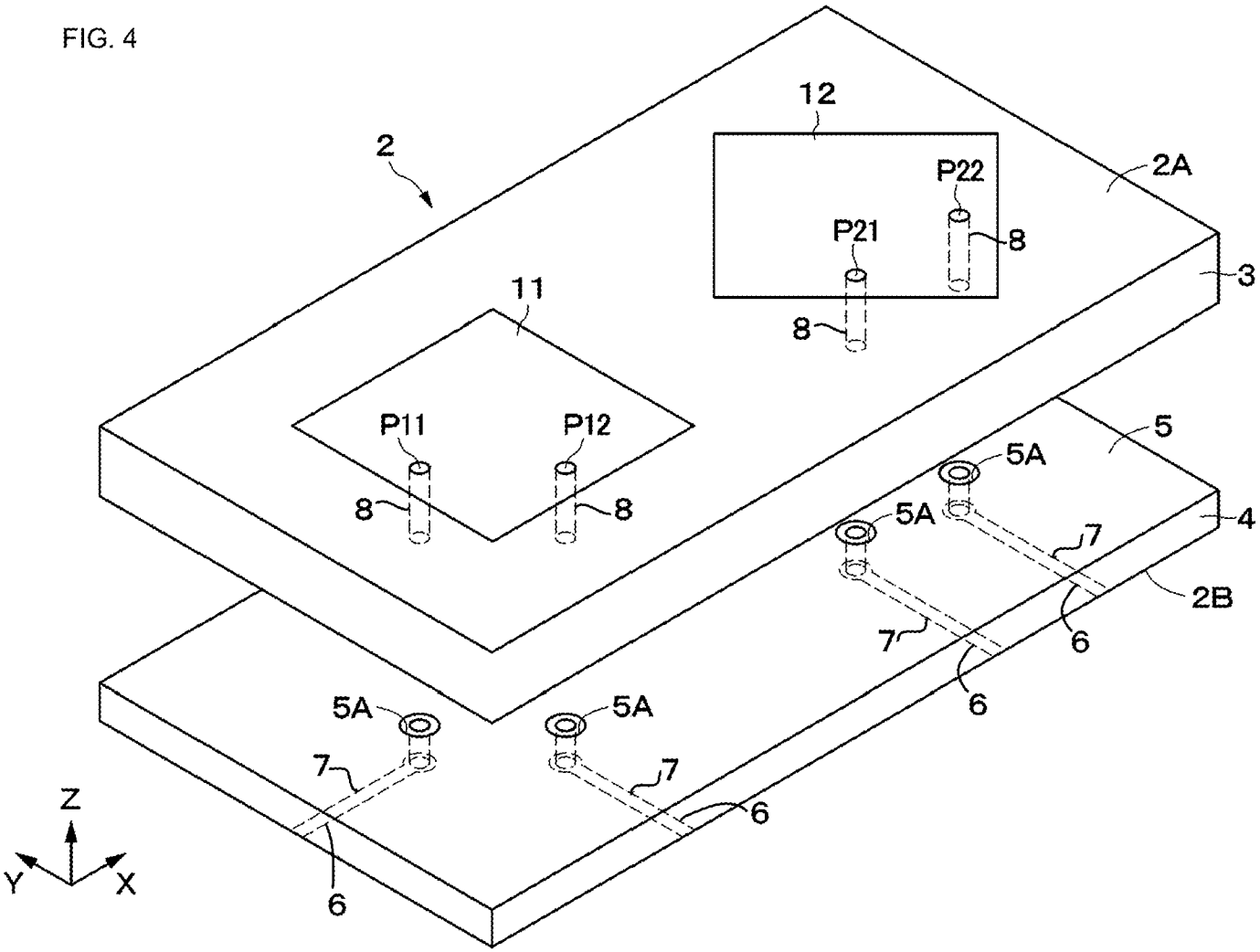
FIG. 4 is an exploded perspective view illustrating the first patch antenna and the second patch antenna illustrated in part A of FIG. 2 taken out.
Figure 5:
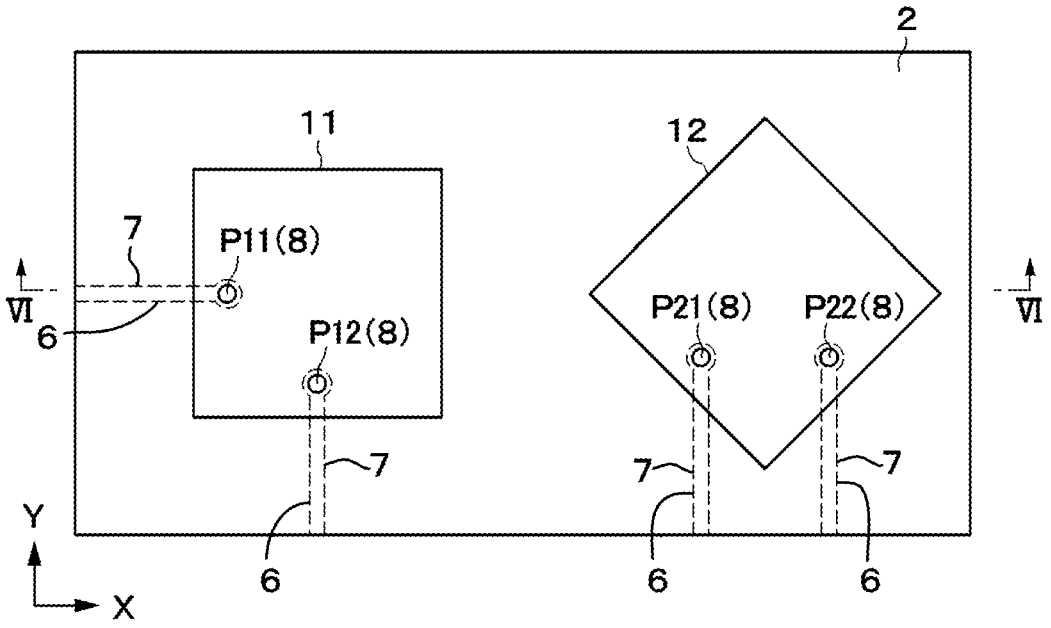
FIG. 5 is a plan view illustrating the first patch antenna and the second patch antenna in FIG. 4.
Figure 6:
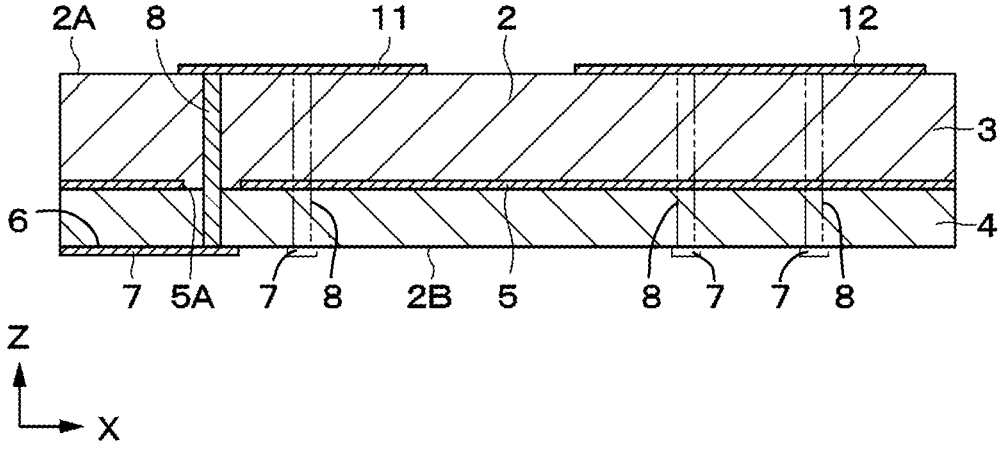
FIG. 6 is a sectional view of the first patch antenna and the second patch antenna as viewed from the direction of arrows VI-VI in FIG. 5.

As illustrated in FIGS. 4 to 6, a multilayer dielectric substrate 2 is formed in a flat plate shape extending parallel, for example, to the X-axis direction and the Y-axis direction among the X-axis direction (length direction), the Y-axis direction (width direction), and the Z-axis direction (thickness direction) orthogonal to each other.

The multilayer dielectric substrate 2 is made of, for example, a ceramic material or a resin material as a material having an insulating property. The multilayer dielectric substrate 2 has two insulating layers 3 and 4 laminated in the Z-axis direction from an upper surface 2A side (front surface side) toward a lower surface 2B side (rear surface side). Each of the insulating layers 3 and 4 is formed in a thin layer.

A ground layer 5 is provided between the insulating layer 3 and the insulating layer 4, and covers the multilayer dielectric substrate 2 over substantially the entire surface (see FIGS. 4 and 6). The ground layer 5 is formed using a conductive metal material such as copper, silver, or the like, and is connected to the ground. Specifically, the ground layer 5 is formed of a metal thin film.

A feed line 6 is configured by, for example, a microstrip line (see FIGS. 4 and 6). The feed line 6 is provided on the side opposite to the patch antennas 11 and 12 as viewed from the ground layer 5, and feeds power to the patch antennas 11 and 12. Specifically, the feed line 6 is configured by the ground layer 5 and a strip conductor 7 provided on the side opposite to the patch antennas 11 and 12 as viewed from the ground layer 5. The strip conductor 7 is made of, for example, the same conductive metal material as the ground layer 5, is formed in an elongated strip shape, and is provided on the lower surface 2B (lower surface of the insulating layer 4) of the multilayer dielectric substrate 2.

Further, the end portions of some of the strip conductors 7 are disposed at the center portions of connection openings 5A formed on or in the ground layer 5, and are connected to the first patch antenna 11 at an intermediate position in the X-axis direction or the Y-axis direction through vias 8 as connection lines (see FIG. 5). Thus, the feed lines 6 transmit the high-frequency signals RF11 and RF12 and feed power to the first patch antenna 11 so that currents I11 and I12 flow in the X-axis direction and the Y-axis direction of the first patch antenna 11, respectively (see FIG. 3).

The end portions of the remaining strip conductors 7 are disposed at the center portions of the connection openings 5A formed on or in the ground layer 5, and are connected to the second patch antenna 12 at an intermediate position in the +45 degree direction or the −45 degree direction through the vias 8 as the connection lines (see FIG. 5). Thus, the feed lines 6 transmit the high-frequency signals RF21 and RF22 and feed power to the second patch antenna 12 so that currents I21 and I22 flow in the +45 degree direction and the −45 degree direction of the second patch antenna 12, respectively (see FIG. 3).

The via 8 is formed as a columnar conductor by providing, for example, a conductive metal material such as copper, silver, or the like on a through hole having an inner diameter of about several tens to several hundreds of μm through the multilayer dielectric substrate 2 (insulating layers 3 and 4) (see FIGS. 4 and 6). The via 8 extends in the Z-axis direction. One end of the via 8 is connected to the first patch antenna 11 or the second patch antenna 12. The other end of the via 8 is connected to the strip conductor 7.

Thus, the via 8 constitutes a connection line between the patch antennas 11 and 12 and the feed line 6. The via 8 is connected to the first feed point P11 on the first patch antenna 11 between a center position and a position of the end portion in the X-axis direction and at a substantially center position in the Y-axis direction. Also, the via 8 is connected to the second feed point P12 between a center position and a position of the end portion in the Y-axis direction and at a substantially center position in the X-axis direction (see FIG. 5).

On the other hand, the via 8 is connected to the first feed point P21 on the second patch antenna 12 at an intermediate position between a center position and a position of the end portion in the +45 degree direction. Also, the via 8 is connected to the second feed point P22 at an intermediate position between a center position and a position of the end portion in the −45 degree direction (see FIG. 5).

The first patch antenna 11 is formed of a substantially quadrangular conductor thin film pattern. The first patch antenna 11 is formed using, for example, the same conductive metal material as the ground layer 5.

The first patch antenna 11 faces the ground layer 5 with a distance (see FIG. 6). Specifically, the first patch antenna 11 is disposed on the upper surface of the insulating layer 3 (the upper surface 2A of the multilayer dielectric substrate 2). That is, the first patch antenna 11 is laminated on the upper surface of the ground layer 5 with the insulating layer 3 interposed therebetween. Therefore, the first patch antenna 11 faces the ground layer 5 while being insulated from the ground layer 5.

Figure 3:
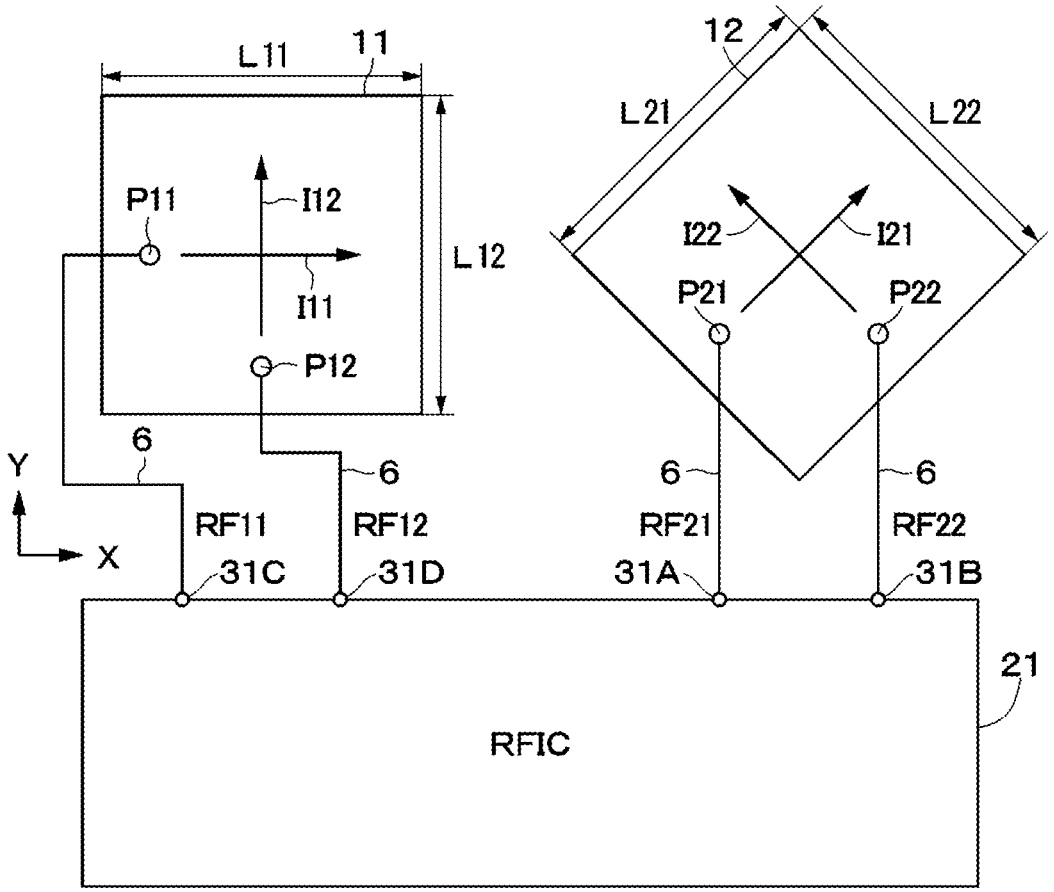
FIG. 3 is a configuration diagram illustrating a first patch antenna and a second patch antenna illustrated in part A of FIG. 2 taken out.

As illustrated in FIG. 3, the first patch antenna 11 has a length dimension L11 of, for example, about several hundreds of μm to several of mm in the X-axis direction, and has a length dimension L12 of, for example, about several hundreds of μm to several of mm in the Y-axis direction. The length dimension L11 of the first patch antenna 11 in the X-axis direction is set to a value that is, for example, a half wavelength of the first high-frequency signal RF11 by an electric length. On the other hand, the length dimension L12 of the first patch antenna 11 in the Y-axis direction is set to a value that is, for example, a half wavelength of the second high-frequency signal RF12 by an electric length. Therefore, when the first high-frequency signal RF11 and the second high-frequency signal RF12 have the same frequency and the same band as each other, the first patch antenna 11 is formed in a substantially square shape.

Further, the first patch antenna 11 has the first feed point P11 to which the via 8 is connected at an intermediate position in the X-axis direction shifted from the center. Therefore, the feed line 6 is connected to the first feed point P11 of the first patch antenna 11 through the via 8. That is, the end portion of the strip conductor 7 is connected to the first patch antenna 11 through the via 8 as a connection line. Then, the current I11 flows through the first patch antenna 11 in the X-axis direction by feeding electric power from the feed line 6 to the first feed point P11.

On the other hand, the first patch antenna 11 has the second feed point P12 to which the via 8 is connected at an intermediate position in the Y-axis direction shifted from the center. Therefore, the feed line 6 is connected to the second feed point P12 of the first patch antenna 11 through the via 8. That is, the end portion of the strip conductor 7 is connected to the first patch antenna 11 through the via 8 as a connection line. Then, the current I12 flows through the first patch antenna 11 in the Y-axis direction by feeding electric power from the feed line 6 to the second feed point P12.

Thus, the first patch antenna 11 can radiate a polarization in the X-axis direction (horizontal polarization) and a polarization in the Y-axis direction (vertical polarization) as two polarizations orthogonal to each other. The first patch antenna 11 constitutes a first dual-polarized antenna capable of radiating two polarizations (horizontal polarization and vertical polarization).

The first feed point P11 may be shifted from the center of the first patch antenna 11 to one side in the X-axis direction, or may be shifted to the other side in the X-axis direction. Similarly, the second feed point P12 may be shifted from the center of the first patch antenna 11 to one side in the Y-axis direction, or may be shifted to the other side in the Y-axis direction.

The second patch antenna 12 is formed substantially in the same manner as the first patch antenna 11. Therefore, the second patch antenna 12 is formed of a substantially quadrangular conductor thin film pattern. The second patch antenna 12 faces the ground layer 5 with a distance. Specifically, similarly to the first patch antenna 11, the second patch antenna 12 is disposed on the upper surface of the insulating layer 3 (the upper surface 2A of the multilayer dielectric substrate 2).

As illustrated in FIG. 3, on the same XY plane as the first patch antenna 11 (on the upper surface 2A), the second patch antenna 12 has a shape obtained by rotating the first patch antenna 11 in a range of, for example, greater than 30 degrees and less than 60 degrees, for example, a shape obtained by rotating the first patch antenna 11 by 45 degrees. Thus, the second patch antenna 12 has a length dimension L21 of, for example, about several hundreds of μm to several of mm in a direction inclined by 45 degrees to the X-axis direction (+45 degree direction), and has a length dimension L22 of, for example, about several hundreds of μm to several of mm in a direction inclined by 45 degrees to the Y-axis direction (−45 degree direction).

At this time, the +45 degree direction is a direction parallel to the direction rotated counterclockwise by 45 degrees to the X-axis direction. The −45 degree direction is a direction parallel to the direction rotated counterclockwise by 45 degrees to the Y-axis direction, and is parallel to the direction rotated clockwise by 45 degrees to the X-axis direction.

The length dimension L21 of the second patch antenna 12 in the +45 degree direction is set to a value that is, for example, a half wavelength of the first high-frequency signal RF21 by an electric length. On the other hand, the length dimension L22 of the second patch antenna 12 in the −45 degree direction is set to a value that is, for example, a half wavelength of the second high-frequency signal RF22 by an electric length. Therefore, when the first high-frequency signal RF21 and the second high-frequency signal RF22 have the same frequency and the same band as each other, the second patch antenna 12 is formed in a substantially square shape.

Further, the second patch antenna 12 has the first feed point P21 to which the via 8 is connected at an intermediate position in the +45 degree direction shifted from the center. Therefore, the feed line 6 is connected to the first feed point P21 of the second patch antenna 12 through the via 8. The current I21 flows through the second patch antenna 12 in the +45 degree direction by feeding electric power from the feed line 6 to the first feed point P21.

On the other hand, the second patch antenna 12 has the second feed point P22 to which the via 8 is connected at an intermediate position in the −45 degree direction shifted from the center. Therefore, the feed line 6 is connected to the second feed point P22 of the second patch antenna 12 through the via 8. The current I22 flows through the second patch antenna 12 in the −45 degree direction by feeding electric power from the feed line 6 to the second feed point P22.

Thus, the second patch antenna 12 can radiate a polarization in the +45 degree direction (+45 degree polarization) and a polarization in the −45 degree direction (−45 degree polarization) as two polarizations orthogonal to each other. The second patch antenna 12 constitutes a second dual-polarized antenna capable of radiating two polarizations (+45 degree polarization and −45 degree polarization).

The first feed point P21 may be shifted from the center of the second patch antenna 12 to one side in the +45 degree direction, or may be shifted to the other side in the +45 degree direction. Similarly, the second feed point P22 may be shifted from the center of the second patch antenna 12 to one side in the −45 degree direction, or may be shifted to the other side in the −45 degree direction.

Therefore, the second patch antenna 12 has the feed points P21 and P22 at positions rotated by 45 degrees, 135 degrees, 225 degrees, or 315 degrees to the feed points P11 and P12 of the first patch antenna 11.

Figure 2:
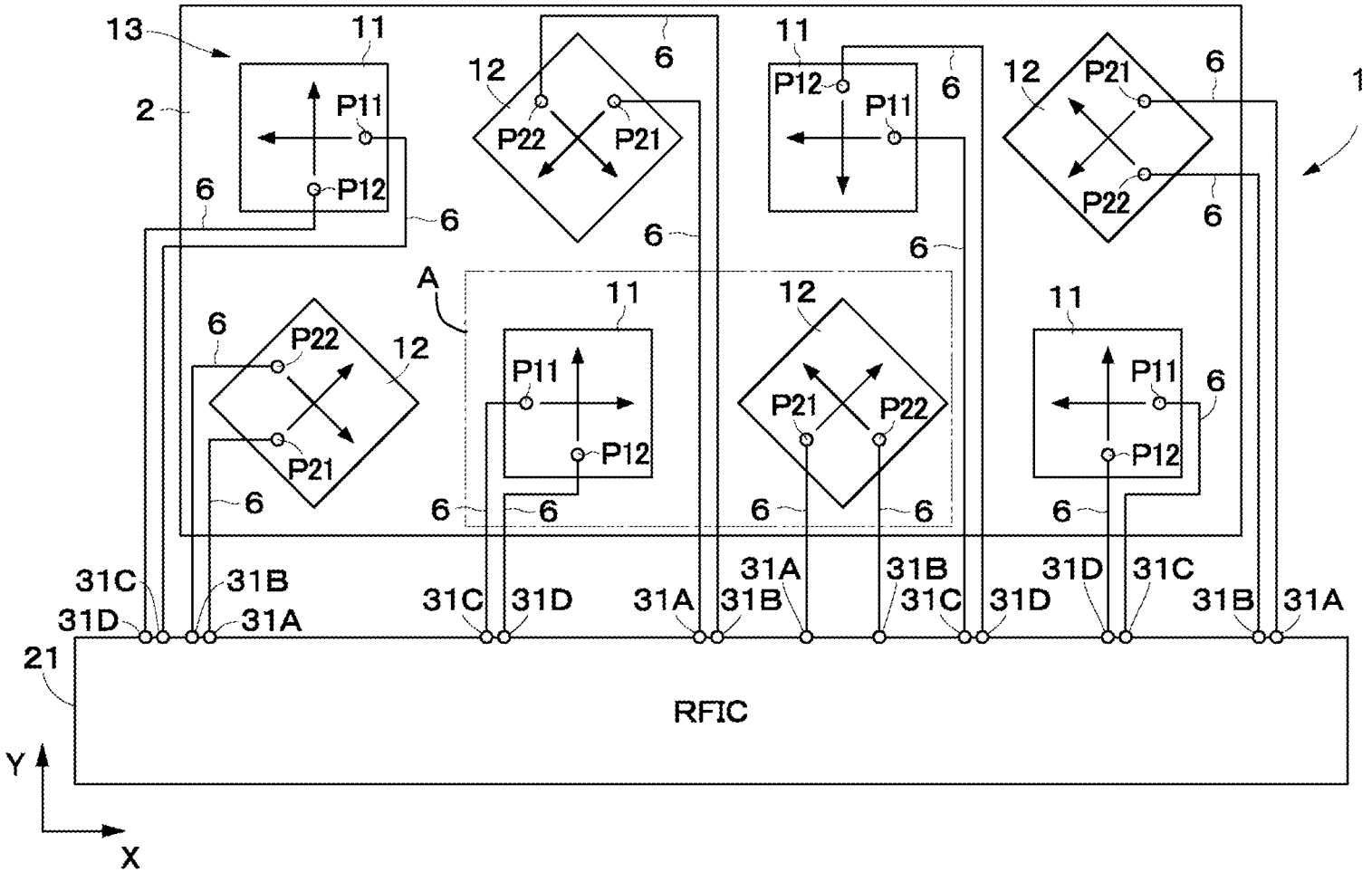
FIG. 2 is an overall configuration diagram illustrating a high-frequency module according to the embodiment of the present disclosure.

As illustrated in FIG. 2, the four first patch antennas 11 and the four second patch antennas 12 constitute the array antenna 13. Thus, a total of eight patch antennas 11 are arranged in a matrix shape (matrix) of, for example, two rows and four columns on the upper surface 2A of the multilayer dielectric substrate 2.

For example, the four first patch antennas 11 are arranged and formed (see FIG. 2) on the upper surface 2A of the multilayer dielectric substrate 2 (see FIG. 6), that is, on the surface of the insulating layer 3. The four first patch antennas 11 have the same polarization directions (horizontal polarization and vertical polarization) as each other. For example, the four second patch antennas 12 are arranged and formed (see FIG. 2) on the upper surface 2A of the multilayer dielectric substrate 2 (see FIG. 6), that is, on the surface of the insulating layer 3. The four second patch antennas 12 have different polarization directions (+45 degree polarization and −45 degree polarization) from the first patch antenna 11, and have the same polarization directions as each other. The four first patch antennas 11 are arranged at equal distances in the X-axis direction, and are arranged in two rows in the Y-axis direction. The four second patch antennas 12 are arranged at equal distances in the X-axis direction, and are arranged in two rows in the Y-axis direction.

At this time, two first patch antennas 11 and two second patch antennas 12 are arranged in each row. However, the first patch antennas 11 and the second patch antennas 12 are alternately arranged in the X-axis direction. In addition, the first patch antenna 11 and the second patch antenna 12 are alternately arranged in the Y-axis direction.

Thus, the four first patch antennas 11 are arranged on the upper surface 2A of the multilayer dielectric substrate 2 in an alternating way (alternating positions). At this time, the four first patch antennas 11 are arranged with gaps.

The four second patch antennas 12 are arranged on the upper surface 2A of the multilayer dielectric substrate 2 in an alternating way (alternating positions). At this time, the four second patch antennas 12 are arranged at positions that fill the spaces between the four first patch antennas 11.

The first patch antennas 11 and the second patch antennas 12 are alternately arranged at equal distances. Accordingly, the first patch antennas 11 and the second patch antennas 12 are arranged adjacent to each other in the X-axis direction and are arranged adjacent to each other in the Y-axis direction.

The array antenna 13 radiates radio waves by using all the patch antennas 11 and 12, and scans the direction of the radiation beam toward the X-axis direction and the Y-axis direction.

Here, for example, when the horizontal polarization or the vertical polarization is radiated, signals are inputted to the one feed point of the first patch antenna 11 (for example, the first feed point P11) and the two feed points of the second patch antenna 12 (for example, the first feed point P21 and the second feed point P22). Also, for example, when the polarization inclined by 45 degrees from the horizontal polarization or the vertical polarization is radiated, signals are inputted to the two feed points of the first patch antenna 11 (for example, the first feed point P11 and the second feed point P12) and the one feed point of the second patch antenna 12 (for example, the first feed point P21). At this time, since the numbers of the first patch antennas 11 and the second patch antennas 12 are the same as each other, the EIRP can always be kept constant. In consideration of this point, the high-frequency signals RF11, RF12, RF21, and RF22 may have different frequencies from each other, but preferably have the same frequency. Accordingly, it is preferable that the first patch antenna 11 and the second patch antenna 12 have the same square shape as each other.

Further, the first patch antenna 11 and the second patch antenna 12 may be multi-band antennas operating in at least two or more frequency bands of a 28 GHz band, a 39 GHz band, and a 60 GHz band, or the first patch antenna 11 and the second patch antenna 12 may be multi-band antennas operating in at least two or more frequency ranges of 24.25 to 29.5 GHz, 37 to 43.5 GHz, and 57 to 73 GHz. However, the frequency bands or the frequency ranges are not limited to these.

The RFIC 21 has the plurality of RF input/output terminals 31A to 31D connected to the multilayer dielectric substrate 2. As illustrated in FIGS. 2 and 3, the RFIC 21 includes at least, the corresponding switches 22A to 22D, 24A to 24D, and 28, each serving as a switching device for switching on/off of input or output of the RF signal (high-frequency signals RF11, RF12, RF21, or RF22) and the corresponding variable phase shifters 26A to 26D, for each of the plurality of RF input/output terminals 31A to 31D (see FIG. 1).

At this time, the switches 22A to 22D, 24A to 24D, and 28 have a function (function of switching for each antenna) of selecting the patch antenna 11 or 12 for transmitting and receiving signals and the feed point P11, P12, P21, or P22. A high-frequency signal is fed only to the patch antenna and the feed point selected by the switches 22A to 22D, 24A to 24D, and 28. A high-frequency signal is fed only from the patch antenna and the feed point selected by the switches 22A to 22D, 24A to 24D, and 28.

The high-frequency signals RF11 and RF12 are fed from the RFIC 21 to the first feed point P11 and the second feed point P12 of the first patch antenna 11. Thus, the high-frequency signal RF11 is radiated from the first patch antenna 11 as a radio wave having a polarization component in the X-axis direction. Also, the high-frequency signal RF12 is radiated from the first patch antenna 11 as a radio wave having a polarization component in the Y-axis direction.

The radio waves of the high-frequency signals RF11 and RF12 received by the first patch antenna 11 are fed to the RFIC 21. The variable phase shifters 26C and 26D can independently control the phases of the high-frequency signals RF11 and RF12 for each of the first feed point P11 and the second feed point P12.

Similarly, the high-frequency signals RF21 and RF22 are fed from the RFIC 21 to the first feed point P21 and the second feed point P22 of the second patch antenna 12. Thus, the high-frequency signal RF21 is radiated from the second patch antenna 12 as a radio wave having a polarization component in the +45 degree direction. Also, the high-frequency signal RF22 is radiated from the second patch antenna 12 as a radio wave having a polarization component in the −45 degree direction.

The radio waves of the high-frequency signals RF21 and RF22 received by the second patch antenna 12 are fed to the RFIC 21. The variable phase shifters 26A and 26B can independently control the phases of the high-frequency signals RF21 and RF22 for each of the first feed point P21 and the second feed point P22.

The RFIC 21 is attached to, for example, the lower surface 2B of the multilayer dielectric substrate 2 (see FIG. 6). The RF input/output terminals 31A to 31D of the RFIC 21 are electrically connected to the feed lines 6 (see FIG. 3). Thus, the RFIC 21 is electrically connected to the first patch antenna 11 and the second patch antenna 12 via the feed lines 6 and the vias 8. The RFIC 21 may be attached to the upper surface 2A of the multilayer dielectric substrate 2. Further, when the RF input/output terminal 31 is electrically connected to the feed line 6, the RFIC 21 may be attached to a member separate from the multilayer dielectric substrate 2.

The high-frequency module 1 according to the present embodiment has the configuration as described above, and the operation thereof will be described.

When power is fed to the first feed point P11 of the first patch antenna 11, the current I11 flows through the first patch antenna 11 in the X-axis direction. Thus, the first patch antenna 11 radiates the radio wave of the high-frequency signal RF11 which has become the horizontal polarization upward from the upper surface 2A of the multilayer dielectric substrate 2, and the first patch antenna 11 receives the radio wave of the high-frequency signal RF11.

In this case, by receiving the phase-adjusted signals at the two feed points P21 and P22 of the second patch antenna 12, the second patch antenna 12 can radiate the radio wave parallel to the horizontal polarization. Thus, it is possible to transmit or receive the radio wave of the high-frequency signal RF11 which has been horizontally polarized by using all of the patch antennas 11 and 12.

Similarly, when power is fed to the second feed point P12 of the first patch antenna 11, the current I12 flows through the first patch antenna 11 in the Y-axis direction. Thus, the first patch antenna 11 radiates the radio wave of the high-frequency signal RF12 which has become the vertical polarization upward from the upper surface 2A of the multilayer dielectric substrate 2, and the first patch antenna 11 receives the radio wave of the high-frequency signal RF12.

In this case, by receiving the phase-adjusted signals at the two feed points P21 and P22 of the second patch antenna 12, the second patch antenna 12 can radiate the radio wave parallel to the vertical polarization. Thus, it is possible to transmit or receive the radio wave of the high-frequency signal RF12 which has been vertically polarized by using all of the patch antennas 11 and 12.

On the other hand, when power is fed to the first feed point P21 of the second patch antenna 12, the current I21 flows through the second patch antenna 12 in the +45 degree direction. Thus, the second patch antenna 12 radiates the radio wave of the high-frequency signal RF21 which has become the +45 degree polarization upward from the upper surface 2A of the multilayer dielectric substrate 2, and the second patch antenna 12 receives the radio wave of the high-frequency signal RF21.

In this case, by receiving the phase-adjusted signals at the two feed points P11 and P12 of the first patch antenna 11, the first patch antenna 11 can radiate the radio wave parallel to the +45 degree polarization. Thus, it is possible to transmit or receive the radio wave of the high-frequency signal RF21 which has been polarized at +45 degree by using all of the patch antennas 11 and 12.

Similarly, when power is fed to the second feed point P22 of the second patch antenna 12, the current I22 flows through the second patch antenna 12 in the −45 degree direction. Thus, the second patch antenna 12 radiates the radio wave of the high-frequency signal RF22 which has become the −45 degree polarization upward from the upper surface 2A of the multilayer dielectric substrate 2, and the second patch antenna 12 receives the radio wave of the high-frequency signal RF22.

In this case, by receiving the phase-adjusted signals at the two feed points P11 and P12 of the first patch antenna 11, the first patch antenna 11 can radiate the radio wave parallel to the −45 degree polarization. Thus, it is possible to transmit or receive the radio wave of the high-frequency signal RF22 which has been polarized at −45 degree by using all of the patch antennas 11 and 12.

In addition, the high-frequency module 1 can scan the direction of the horizontally polarized radiation beam in the X-axis direction and the Y-axis direction by appropriately adjusting the phases of the high-frequency signals RF11 to be fed to the plurality of first patch antennas 11 and the plurality of second patch antennas 12. Similarly, the high-frequency module 1 can scan the direction of the vertically polarized radiation beam in the X-axis direction and the Y-axis direction by appropriately adjusting the phases of the high-frequency signals RF12 to be fed to the plurality of first patch antennas 11 and the plurality of second patch antennas 12.

In addition, the high-frequency module 1 can scan the direction of the +45 degree polarized radiation beam in the X-axis direction and the Y-axis direction by appropriately adjusting the phases of the high-frequency signals RF21 to be fed to the plurality of first patch antennas 11 and the plurality of second patch antennas 12. Similarly, the high-frequency module 1 can scan the direction of the −45 degree polarized radiation beam in the X-axis direction and the Y-axis direction by appropriately adjusting the phases of the high-frequency signals RF22 to be fed to the plurality of first patch antennas 11 and the plurality of second patch antennas 12.

In the high-frequency module 1 according to the present embodiment, half of the patch antennas 11 and 12 of the array antenna 13 are the first patch antennas 11, and the remaining half are the second patch antennas 12. Further, the second patch antenna 12 has feed points P21 and P22 at positions rotated at any one angle of 45 degrees, 135 degrees, 225 degrees, or 315 degrees to the feed points P11 and P12 of the first patch antenna 11. In addition, both the first patch antenna 11 and the second patch antenna 12 simultaneously operate as a transmitting antenna or a receiving antenna.

In the high-frequency module 1 according to the present embodiment, for example, the transmission power can be enhanced by 1.5 times in any polarization of the horizontal polarization, vertical polarization, and ±45 degree polarizations as compared with the conventional array antenna in which power is fed all from the same direction. Therefore, the EIRP can be enhanced by 1.5 times (about 1.7 dB).

Specifically, first, the gain of each of the antenna 11 and 12 is assumed to be G, and the input power of each RF input/output terminal 31 is assumed to be P. For example, in order to implement the horizontal polarization, power is fed to the feed points P11 of all the first patch antennas 11, and power is fed to the feed points P21 and P22 of all the second patch antennas 12.

At this time, assuming that the number of the first patch antennas 11 is N1 and the number of the second patch antennas 12 is N2, the total number of antennas Na of the operating patch antennas 11 and 12 is the sum of the number of the antennas N1 and the number of the antennas N2, as represented by Equation 1. Here, the number of antennas N1 (for example, N1=4) and the number of antennas N2 (for example, N2=4) are the same (N1=N2). Therefore, as represented by Equation 2, the number of terminals Nt of the RF input/output terminals 31 to which power is fed is the sum of the number of antennas N1 and twice the number of antennas N2, so that the number of terminals Nt is 1.5 times the number of antennas Na.

$$Na = N1 + N2 \quad \text{[Equation 1]}$$

$$\begin{aligned} Nt &= N1 + 2 \times N2 \\ &= 1.5 \times Na \end{aligned} \quad \text{[Equation 2]}$$

In addition, as represented by Equation 3, the total gain TG is a product of the number of antennas Na and the gain G. Further, as represented by Equation 4, the transmission power TP is a product of the number of terminals Nt and the input power P for each terminal 31. Therefore, as represented by Equation 5, the EIRP is a product of the total gain TG and the transmission power TP. As a result, the EIRP of the high-frequency module 1 according to the present embodiment can be enhanced by 1.5 times as compared with the minimum EIRP described in Patent Document 3. The above-described effect of enhancing the EIRP can also be obtained when the patch antennas 11 and 12 radiate the vertical polarizations or the ±45 degree polarizations.

$$TG = Na \times G \quad \text{[Equation 3]}$$

$$\begin{aligned} TP &= Nt \times P \\ &= 1.5 \times Na \times P \end{aligned} \quad \text{[Equation 4]}$$

$$\begin{aligned} EIRP &= TG \times TP \\ &= 1.5 \times Na^2 \times G \times P \end{aligned} \quad \text{[Equation 5]}$$

In addition, when radiating any of the horizontal polarization, the vertical polarization, and the ±45 degree polarizations, the signals can be transmitted by using the RF input/output terminals 31 of the same number of terminals Nt. Therefore, when different polarizations are radiated, the antenna gain TG and the transmission power TP can always be kept constant, and power consumption does not fluctuate depending on the use state (polarization to be used).

Further, the directions of the currents I11 and I12 generated in the first patch antenna 11 are inclined by 45 degrees to the directions of the currents I21 and I22 generated in the second patch antenna 12. Since the directions of the current flowing through the first patch antenna 11 and the second patch antenna 12 are different from each other, the coupling therebetween is weakened. As a result, the isolation between the first patch antenna 11 and the second patch antenna 12 can be improved as compared with the case where all the antennas having the same polarization are used.

Thus, in the present embodiment, when the first patch antenna 11 radiates, for example, the horizontal polarization, the second patch antenna 12 can radiate a radio wave parallel to the horizontal polarization by receiving the phase-adjusted signals at the two feed points P21 and P22 of the second patch antenna 12. This is the same when the first patch antenna 11 radiates the vertical polarization. Also, when the second patch antenna 12 radiates ±45 degree polarizations, the first patch antenna 11 can radiate a radio wave parallel to the ±45 degree polarizations by receiving the phase-adjusted signals at the two feed points P11 and P12 of the first patch antenna 11. Thus, since radio waves can be radiated by using both the first patch antenna 11 and the second patch antenna 12, the EIRP can be enhanced as compared with a case where only one type of antennas are used. The direction of the current generated in first patch antenna 11 is inclined by 45 degrees to the direction of the current generated in the second patch antenna 12. Therefore, the mutual coupling between the first patch antenna 11 and the second patch antenna 12 can be suppressed, and the isolation can be enhanced.

For example, when the horizontal polarization is radiated, the signals are inputted to the one feed point P11 of the first patch antenna 11 and the two feed points P21 and P22 of the second patch antenna 12. Similarly, for example, when the vertical polarization is radiated, the signals are inputted to the one feed point P12 of the first patch antenna 11 and the two feed points P21 and P22 of the second patch antenna 12. Further, for example, when the +45 degree polarization is radiated, the signals are inputted to the two feed points P11 and P12 of the first patch antenna 11 and the one feed point P21 of the second patch antenna 12. Similarly, for example, when the −45 degree polarization is radiated, the signals are inputted to the two feed points P11 and P12 of the first patch antenna 11 and the one feed point P22 of the second patch antenna 12. At this time, since the numbers of the first patch antennas 11 and the second patch antennas 12 are the same (four) as each other, the EIRP can always be kept constant.

Further, the one second patch antenna 12 is arranged between the two first patch antennas 11. Therefore, the two first patch antennas 11 can be arranged apart from each other, and the isolation therebetween can be enhanced. Similarly, the one first patch antenna 11 is arranged between the two second patch antennas 12. Therefore, the two second patch antennas 12 can be arranged apart from each other, and the isolation therebetween can be enhanced.

In addition, the plurality of first patch antennas 11 are arranged at positions that fill the spaces between the plurality of second patch antennas 12. Similarly, the plurality of second patch antennas 12 are arranged at positions that fill the spaces between the plurality of first patch antennas 11. Thus, since both the patch antennas 11 and 12 are arranged without space on the upper surface 2A of the multilayer dielectric substrate 2, radio waves can be radiated from the entire upper surface 2A. Therefore, the radiation efficiency of radio waves per unit area of the upper surface 2A can be enhanced.

In the above-described embodiment, the quadrangular patch antennas 11 and 12 constitute dual-polarized antennas (first dual-polarized antenna and second dual-polarized antenna). The present disclosure is not limited thereto, and the dual-polarized antenna may be configured by a circular, elliptical, or polygonal patch antenna. Alternatively, the dual-polarized antenna may be configured by two dipole antennas crossing each other in a cross shape. Further, the dual-polarized antenna may be configured by a slot antenna with crossing slots.

In the above-described embodiment, the second patch antenna 12 (second dual-polarized antenna) radiates +45 degree polarization and −45 degree polarization as polarization directions positioned between the horizontal polarization and the vertical polarization of the first patch antenna 11 (first dual-polarized antenna). The present disclosure is not limited thereto, and the second patch antenna 12 may radiate, for example, +30 degree polarization and −60 degree polarization, or may radiate +40 degree polarization and −50 degree polarization. That is, the second patch antenna 12 may have polarization directions positioned between the two polarizations (horizontal polarization and vertical polarization) of the first patch antenna 11.

However, the first patch antenna 11 radiates the polarization parallel to the polarization direction of the second patch antenna 12. Similarly, the second patch antenna 12 radiates the polarization parallel to the polarization direction of the first patch antenna 11. In consideration of this point, the second patch antenna 12 preferably has a polarization direction in a direction inclined by a specified angle in a range close to 45 degrees (for example, a range of 40 degrees or more and 50 degrees or less) to the two polarizations (horizontal polarization and vertical polarization) of the first patch antenna 11.

In the above-described embodiment, the array antenna 13 has been described as an example in which the plurality of first patch antennas 11 and second patch antennas 12 are arranged in a matrix shape (matrix) of two rows and four columns. The present disclosure is not limited thereto, and the array antenna 13 may include a plurality of patch antennas arranged in an arbitrary matrix of M rows and N columns (M and N are natural numbers). Alternatively, the array antenna may include a plurality of first patch antennas 11 and second patch antennas 12 arranged in one row (in straight line).

In the above-described embodiment, the array antenna 13 has been described as an example having four first patch antennas 11 and four second patch antennas 12. The present disclosure is not limited thereto, and the number of the first patch antennas 11 may be two, three, or five or more. Similarly, the number of the second patch antennas 12 may be two, three, or five or more.

In the above-described embodiment, all the four first patch antennas 11 and four second patch antennas 12 are used to radiate the radio waves of horizontal polarization, vertical polarization, and ±45 degree polarizations. The present disclosure is not limited thereto, and may radiate radio waves of horizontal polarization, vertical polarization, and ±45 degree polarizations by using a part of the four first patch antennas 11 and the four second patch antennas 12. In this case, the plurality of RFICs 21 turn on the signal input to the patch antennas to be an operation state (connection state) and turn off the signal input to the patch antennas to be a non-operation state (cut off state).

In the above-described embodiment, the case where the number of the first patch antennas 11 and the number of the second patch antennas 12 are the same as each other has been described as an example. The present disclosure is not limited thereto, and the number of the first patch antennas 11 and the number of the second patch antennas 12 may be different from each other. In this case, in order to keep the EIRP constant in any of the horizontal polarization, the vertical polarization, and the ±45 degree polarizations, it is preferable that the number of the first patch antennas 11 in the operation state and the number of the second patch antennas 12 in the operation state be the same as each other.

In the above-described embodiment, the case where the first patch antenna 11 and the second patch antenna 12 are alternately arranged in the X-axis direction and the Y-axis direction has been described as an example. The present disclosure is not limited thereto, and for example, two first patch antennas 11 may be arranged adjacent to each other, and two second patch antennas 12 may be arranged adjacent to each other. However, in order to enhance the isolation between the two first patch antennas 11 and the isolation between the two second patch antennas 12, it is preferable to alternately arrange the first patch antennas 11 and the second patch antennas 12.

In the above-described embodiment, the RFIC 21 includes the power amplifiers 23AT to 23DT, the variable phase shifters 26A to 26D, and the low noise amplifiers 23AR to 23DR. The present disclosure is not limited thereto, and the RFIC 21 may include a transmission circuit and a reception circuit in addition to the power amplifiers 23AT to 23DT, the variable phase shifters 26A to 26D, and the low noise amplifiers 23AR to 23DR.

In the above-described embodiment, the case where the microstrip line is used as the feed line 6 has been described as an example, but another feed line such as a strip line, a coplanar line, a coaxial cable, or the like may also be used.

Further, in the above-described embodiment, although the high-frequency module 1 used for the millimeter waves has been described as an example, for example, it may be applied to a high-frequency module used for a high-frequency signal in another frequency band such as microwaves.

Next, the disclosure included in the above-described embodiment will be described. In the present disclosure, a high-frequency module includes a multilayer dielectric substrate, an RFIC having a plurality of RF input/output terminals connected to the multilayer dielectric substrate, and an array antenna configured by a plurality of dual-polarized antennas, each placed in or on the multilayer dielectric substrate and radiating two orthogonal polarizations, in which the RFIC has at least, for each of the plurality of RF input/output terminals, a switching device for switching on/off of input or output of an RF signal and a variable phase shifter, and two of the plurality of RF input/output terminals are respectively connected to feed points corresponding to orthogonal polarizations in each of the plurality of dual-polarized antennas, in which the plurality of dual-polarized antennas are configured by a plurality of first dual-polarized antennas having identical polarization directions with each other and a plurality of second dual-polarized antennas having identical polarization directions with each other, which are polarization directions positioned between two orthogonal polarizations of each of the first dual-polarized antennas, and each of the first dual-polarized antennas and each of the second dual-polarized antennas simultaneously operate as a transmitting antenna or a receiving antenna.

According to the present disclosure, when the first dual-polarized antenna radiates, for example, the horizontal polarization, the second dual-polarized antenna can radiate a radio wave parallel to the horizontal polarization by inputting phase-adjusted signals to the two feed points of the second dual-polarized antenna. This is the same when the first dual-polarized antenna radiates the vertical polarization. When the second dual-polarized antenna radiates the polarization positioned between the horizontal polarization and the vertical polarization (for example, inclined by 45 degrees), the first dual-polarized antenna can radiate a radio wave parallel to the polarization positioned between the horizontal polarization and the vertical polarization by inputting the phase-adjusted signals to the two feed points of the first dual-polarized antenna. Thus, since the radio waves can be radiated by using both the first dual-polarized antenna and the second dual-polarized antenna, the EIRP can be enhanced as compared with a case where only one type of antennas are used. The direction of the current generated in the first dual-polarized antenna is inclined to the direction of the current generated in the second dual-polarized antenna. Therefore, the mutual coupling between the first dual-polarized antenna and the second dual-polarized antenna can be suppressed, and the isolation can be enhanced.

In the present disclosure, the second dual-polarized antenna has a feed point at a position rotated by 45 degrees, 135 degrees, 225 degrees, or 315 degrees to corresponding one of the first dual-polarized antennas.

According to the present disclosure, the second dual-polarized antenna has a feed point at a position rotated by 45 degrees, 135 degrees, 225 degrees, or 315 degrees to corresponding one of the first dual-polarized antennas. Therefore, when the first dual-polarized antenna radiates, for example, a horizontal polarization or vertical polarization, the second dual-polarized antenna can radiate a polarization inclined by 45 degrees from the horizontal polarization and vertical polarization. At this time, the direction of the current generated in the first dual-polarized antenna is inclined by 45 degrees to the direction of the current generated in the second dual-polarized antenna. Therefore, the mutual coupling between the first dual-polarized antenna and the second dual-polarized antenna can be suppressed, and the isolation can be enhanced.

In the present disclosure, the numbers of the first dual-polarized antennas and the second dual-polarized antennas are identical with each other.

According to the present disclosure, for example, when the horizontal polarization or the vertical polarization is radiated, signals are inputted to the one feed point of the first dual-polarized antenna and the two feed points of the second dual-polarized antenna. Also, for example, when the polarization inclined by 45 degrees from the horizontal polarization or the vertical polarization is radiated, signals are inputted to the two feed points of the first dual-polarized antenna and the one feed point of the second dual-polarized antenna. At this time, since the numbers of the first dual-polarized antennas and the second dual-polarized antennas are the same as each other, the EIRP can always be kept constant.

In the present disclosure, the first dual-polarized antennas and the second dual-polarized antennas are adjacently and alternately arranged.

According to the present disclosure, the one second dual-polarized antenna is arranged between the two first dual-polarized antennas. Therefore, the two first dual-polarized antennas can be arranged apart from each other, and the isolation therebetween can be enhanced. Similarly, one first dual-polarized antenna is arranged between the two second dual-polarized antennas. Therefore, the two second dual-polarized antennas can be arranged apart from each other, and the isolation therebetween can be enhanced.

In the present disclosure, the first dual-polarized antenna and the second dual-polarized antenna are multi-band antennas operating in at least two or more frequency bands of a 28 GHz band, a 39 GHz band, and a 60 GHz band. In the present disclosure, the RFIC is connected to the baseband IC. The high-frequency module of the present disclosure constitutes the communication device.

1 HIGH-FREQUENCY MODULE
2 MULTILAYER DIELECTRIC SUBSTRATE
6 FEED LINE
11 FIRST PATCH ANTENNA (FIRST DUAL-POLARIZED ANTENNA)
12 SECOND PATCH ANTENNA (SECOND DUAL-POLARIZED ANTENNA)
13 ARRAY ANTENNA
21 RFIC
22A TO 22D, 24A TO 24D, 28 SWITCH (SWITCHING DEVICE)
26A TO 26D VARIABLE PHASE SHIFTER
31A TO 31D RF INPUT/OUTPUT TERMINAL
41 BASEBAND IC (BBIC)
101 COMMUNICATION DEVICE

The invention claimed is:

1. A high-frequency module comprising:

a multilayer dielectric substrate;

an RFIC having a plurality of RF input/output terminals connected to the multilayer dielectric substrate; and an array antenna configured by a plurality of dual-polarized antennas, each placed on or in the multilayer dielectric substrate and radiating two orthogonal polarizations, wherein the RFIC has, for each of the plurality of RF input/output terminals, a switching device for switching on/off of input or output of an RF signal and a variable phase shifter, and two of the plurality of RF input/output terminals are respectively connected to feed points corresponding to orthogonal polarizations in each of the plurality of dual-polarized antennas, wherein the plurality of dual-polarized antennas are configured by a plurality of first dual-polarized antennas having identical first polarization directions with each other and a plurality of second dual-polarized antennas having identical second polarization directions with each other, the second polarization directions being positioned between two orthogonal polarizations of each of the first dual-polarized antennas, and each of the first dual-polarized antennas and each of the second dual-polarized antennas simultaneously operates as a transmitting antenna or a receiving antenna.

2. The high-frequency module according to claim 1, wherein at least one second dual-polarized antenna of the plurality of second dual-polarized antennas has a feed point at a position rotated by one of 45 degrees, 135 degrees, 225 degrees, or 315 degrees to a corresponding feed point of one first dual-polarized antenna of the plurality of first dual-polarized antennas.

3. The high-frequency module according to claim 2, wherein numbers of the first dual-polarized antennas and the second dual-polarized antennas are identical with each other.

4. The high-frequency module according to claim 2, wherein the first dual-polarized antennas and the second dual-polarized antennas are arranged adjacently and alternately.

5. The high-frequency module according to claim 2, wherein the first dual-polarized antennas and the second dual-polarized antennas are multi-band antennas operating in at least two frequency bands of a 28 GHz band, a 39 GHz band, or a 60 GHz band.

6. The high-frequency module according to claim 2, wherein the RFIC is connected to a baseband IC.

7. A communication device comprising the high-frequency module according to claim 6.

8. The high-frequency module according to claim 1, wherein numbers of the first dual-polarized antennas and the second dual-polarized antennas are identical with each other.

9. The high-frequency module according to claim 8, wherein the first dual-polarized antennas and the second dual-polarized antennas are arranged adjacently and alternately.

10. The high-frequency module according to claim 8, wherein the first dual-polarized antennas and the second dual-polarized antennas are multi-band antennas operating in at least two frequency bands of a 28 GHz band, a 39 GHz band, or a 60 GHz band.

11. The high-frequency module according to claim 8, wherein the RFIC is connected to a baseband IC.

12. A communication device comprising the high-frequency module according to claim 11.

13. The high-frequency module according to claim 1, wherein the first dual-polarized antennas and the second dual-polarized antennas are arranged adjacently and alternately.

14. The high-frequency module according to claim 13, wherein the first dual-polarized antennas and the second dual-polarized antennas are multi-band antennas operating in at least two frequency bands of a 28 GHz band, a 39 GHz band, or a 60 GHz band.

15. The high-frequency module according to claim 13, wherein the RFIC is connected to a baseband IC.

16. A communication device comprising the high-frequency module according to claim 15.

17. The high-frequency module according to claim 1, wherein the first dual-polarized antennas and the second dual-polarized antennas are multi-band antennas operating in at least two frequency bands of a 28 GHz band, a 39 GHz band, or a 60 GHz band.

18. The high-frequency module according to claim 17, wherein the RFIC is connected to a baseband IC.

19. The high-frequency module according to claim 1, wherein the RFIC is connected to a baseband IC.

20. A communication device comprising the high-frequency module according to claim 19.

* * * * *